United States Patent [19]

Fujimori

[11] 4,241,657

[45] Dec. 30, 1980

[54] FOUR-COLOR HALFTONE PRINTING PROCESS FOR OBJECTS HAVING CURVED SURFACE

[75] Inventor: Hikoichiro Fujimori, Osaka, Japan

[73] Assignee: Takeuchi Press Industries Co., Ltd., Toyama, Japan

[21] Appl. No.: 954,246

[22] Filed: Oct. 24, 1978

[30] Foreign Application Priority Data

Jul. 15, 1978 [JP] Japan ..... 53-86536

[51] Int. Cl.[3] ..... B41F 17/08; B41M 1/14

[52] U.S. Cl. ..... 101/211; 101/175; 101/40

[58] Field of Search ..... 101/211, 175, 40

[56] References Cited

U.S. PATENT DOCUMENTS

| | | | |
|---|---|---|---|
| 2,972,298 | 2/1961 | DeMarchi et al. | 101/211 |
| 3,255,695 | 6/1966 | Johnson et al. | 101/211 |
| 3,593,661 | 7/1971 | Tripp | 101/175 |
| 3,613,571 | 10/1971 | Russell et al. | 101/247 X |
| 4,035,214 | 7/1977 | Shuppert et al. | 101/175 X |

OTHER PUBLICATIONS

*Beverage World*, "Improved Can Graphics Are No Illusion", p. 28, Aug. 1978.

*Primary Examiner*—Clifford D. Crowder

*Attorney, Agent, or Firm*—Armstrong, Nikaido, Marmelstein & Kubovcik

[57] ABSTRACT

A process of four-color halftone printing onto objects having a curved surface by means of dry offset printing which comprises transferring four images of yellow, magenta, cyan and black process inks having a difference of at least 1 in tackiness value from each other from four blocks onto two transfer areas provided on a blanket differently in the circumferential direction of a blanket cylinder in two layers two by two so that an image of an ink having the highest tackiness value and an image of an ink having the secondarily high tackiness value are transferred onto the first transfer area in that order and an image of an ink having the thirdly high tackiness value and an image of an ink having the lowest tackiness value are transferred onto the second transfer area in that order, and then transferring the images on the first transfer area and the images on the second transfer area in order onto the object having a curved surface in layers. Improved four-color halftone printing apparatus for objects having a curved surface is provided with a blanket cylinder having an effective printing surface of twice the size of the printing surface of the objects. The reproducibility of color and images is very excellent and the printing closely resembling the original can be obtained.

3 Claims, 5 Drawing Figures

FOUR-COLOR HALFTONE PRINTING PROCESS FOR OBJECTS HAVING CURVED SURFACE

BACKGROUND OF THE INVENTION

The present invention relates to four-color halftone printing onto objects having a curved surface, and more particularly to a process for conducting four-color halftone printing onto cylindrical, conical and elliptical objects by means of a dry offset printing process and a curved surface printing machine used therefor by means of a dry offset printing.

Printing of cylindrical metallic cans and tubes is usually conducted by a dry offset printing process, and a four-color tube printing machine is widely employed for multicolor printing at the present time. In the printing using such a printing machine, halftone images of four colors are first transferred onto the same position on a blanket in order from each block supported on four block cylinders arranged around a blanket cylinder, and then transferred from the blanket onto a can or tube which is set to a mandrel provided on a rotating disc and is rotatable in contact with the blanket by the rotation of the blanket cylinder. However, such a known tube printing process has the disadvantage that when patterns transferred onto the blanket from blocks overlap each other, the inks in a wet state draw each other and are mixed together, and as a result, the hue changes into an entirely different one. Therefore, it is very difficult to conduct three-color or four-color halftone printing to reproduce the same color as the original, and a conventional tube printing has been limited in design.

OBJECTS OF THE INVENTION

It is an object of the present invention to provide an improved process of four-color halftone printing onto objects having a curved surface.

A further object of the invention is to provide a process of four-color halftone printing onto objects having a curved surface, which is reproducible the same color as the original.

A still further object of the invention is to provide a process of dry offset tube printing, which can reproduce the same color as the original and can fast and continuously provide an elaborate impression.

Another object of the invention is to provide a curved surface printing machine improved for conducting four-color halftone printing onto objects having a curved surface.

These and other objects of the invention will become apparent from the description hereinafter.

DETAILED DESCRIPTION

Figure 1:
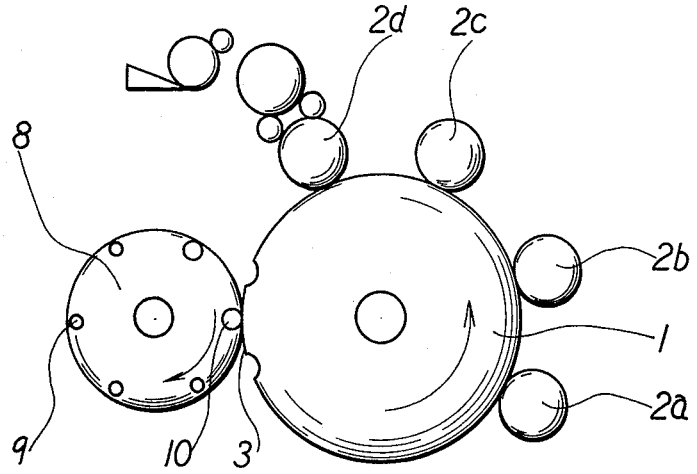
FIG. 1 is a schematic elevation of a curved surface printing machine usable in the process of the present invention.

It has now been found that the above-mentioned object having a curved surface wherein halftone images of four process inks are transferred from blocks onto a blanket and then transferred from the blanket onto the object to be printed, maintaining the difference in tackiness value of the four inks at least 1 from each other, transferring the four images from blocks onto two transfer areas provided on the blanket differently in the circumferential direction of a blanket cylinder in two layers two by two in such a manner that the image of an ink having the highest tackiness value and the image of an ink having the secondarily high tackiness value are transferred onto the first transfer area in that order and the image of an ink having the thirdly high tackiness value and the image of an ink having the lowest tackiness value are transferred onto the second transfer area in that order, and then transferring the images on the first transfer area and the images on the second transfer area in order onto the object in layers.

According to the process of the present invention, mixture of inks can be extremely decreased, since halftone images of four inks having the specific difference in tackiness value from each other are transferred onto two transfer areas of a blanket in two layers two by two in the specific order, followed by the transferrence of the t images on the two transfer areas onto an object to be printed. Therefore, no change in hue nor lack of the sharpness due to the flow of halftone dots is seen, and it is possible to obtain an impression of clear image and color closely resembling the original.

The process of the present invention is applicable to the printing of objects having a curved surface such as cylindrical, conical and elliptical objects, and is particularly suited for the printing of metallic tubes and cans. According to the process of the present invention, it is possible to continuously print them beautifully at a relatively high speed.

One of the features of the present invention lies in the elimination of the mixture of inks due to the adhesion of inks to each other by providing two transfer areas consisting of a first transfer area and a second transfer area on a blanket and transferring four halftone images two by two onto each transfer area in two layers, unlike a conventional tube printing process in which halftone images are transferred from blocks in order onto single transfer area of the blanket. Since two transfer areas are provided on the surface of the blanket, the blanket requires twice the length in the circumferential direction of a conventional one. In other words, the effective printing surface of a blanket cylinder requires twice the size of the printing surface of an object to be printed, and two surface areas are usually provided on one blanket. It is desirable to employ as hard blanket as possible in the reproducibility of sharp dots. Also, one or more blankets may be provided on the blanket cylinder.

In the process of the present invention, halftone images of respective color are transferred from each block on four block cylinders arranged around the blanket cylinder in order onto two transfer areas of the blanket to form two transferred images, each of which consists of two layers, and the transferred images on the first transfer area is then transferred onto an object to be printed which is fixed to a rotatable mandrel provided on a rotating disc, followed by the transference of the transferred images on the second transfer area so as to finally transfer the four halftone images of four colors onto the surface of the object to give a color printing. While the blanket cylinder makes one revolution, the transference from the blocks onto the blanket surface and the transference from the blanket surface onto the surface of an object to be printed are completed, and while the transferred images on the first and second transfer areas are transferred from the blanket onto the object to be printed, the object makes two revolutions. When single blanket is provided on the blanket cylinder, one object can be printed during one revolution of the blanket cylinder, and when two blankets are provided on the blanket cylinder, two objects can be printed during one revolution of the blanket cylinder. In case of using the blanket cylinder provided with single blanket, the speed of revolution of the blanket cylinder is usually selected from 25 to 80 r.p.m.

The four-color halftone printing in the present invention is carried out by a known dry offset process. Yellow, magenta, cyan and black halftone blocks are prepared by a usual photomechanical process. As printing inks, usual process inks of yellow, magenta, cyan and black colors are employed, and it is desirable to employ inks having a high viscosity and concentration, particularly having an excellent wettability and reproducibility in halftone dot.

The order of the transference of four inks from blocks to a blanket is not particularly limited with respect to the color. However, in order to prevent mixing of inks at the time of transferring from blocks onto a blanket and from the blanket onto an object to be printed so as to be transferred in good state, it is important to maintain the tackiness values of the inks so that an ink to be transferred onto the first transfer area as an under layer has the highest tackiness value and an ink to be transferred onto the second transfer area as an upper layer has the lowest tackiness value, and moreover the difference in tackiness value of the four inks is at least 1, preferably 2 to 3 at 25° C. from each other. This is another feature of the present invention. When four inks have not the above specific tack balance, smooth transference is not conducted and inks are mixed, and as a result, the reproducibility of color and the sharpness are decreased.

In a printing process in which inks are transferred in layers in a wet state, mixture of inks due to adhesion of inks to each other becomes a large problem. The process of the present invention has eliminated this problem by transferring four ink images separately onto two areas and differentiating the tackiness values of four inks. Therefore, according to the present invention, since onto a previously transferred image layer the next image is transferred so as to adhere to the previous image layer without drawing it, no mixing of inks takes place and smooth transference can be made.

The transference of halftone images from blocks onto a blanket are conducted in such a way that a halftone image of an ink having the highest tackiness value is transferred onto the first transfer area as an under layer onto which a halftone image of an ink having a secondarily high tackiness value is transferred, and a halftone image of an ink having the lowest tackiness value is transferred onto the second transfer area as an upper layer. Then, the image layers on the first transfer area are first transferred onto an object to be printed, and onto which the image layers on the second transfer area are successively transferred so that four halftone images are finally transferred onto the object in layers. The tackiness value of a previously transferred ink is always higher than the tackiness value of an ink transferred thereon and, therefore, inks are not mixed and the transference is smoothly conducted. It is necessary to differentiate the tackiness values of four inks in order to make the tackiness value of an under layer ink higher than the tackiness value of an upper layer ink.

The tackiness values of four inks are maintained to have a difference of at least 1, preferably 2 to 3 at 25° C. from each other. The tackiness value of an ink is selected from 13 to 45, preferably 18 to 40 (Inkometer at 25° C.), and for instance, four inks are adjusted to have tackiness values of 29 to 27, 26 to 24, 23 to 21 and 20 to 18, respectively. The tackiness value of ink can be readily adjusted by employing known reducers and compounds without lowering the viscosity of ink. The adjustment of tackiness value is usually conducted by employing compounds, and for instance, the tackiness value may be lowered by 10 to 15% by the addition of about 4 to 5% by weight of a compound based on the weight of an ink.

The process of the present invention will be explained particularly with reference to the drawings, but these drawings are intended to illustrate the invention and are not to be construed to limit the invention.

Figure 2:
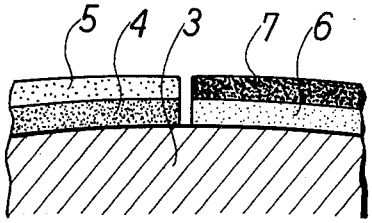
FIG. 2 is a schematic partially sectional view showing image layers transferred onto a blanket.
Figure 3:
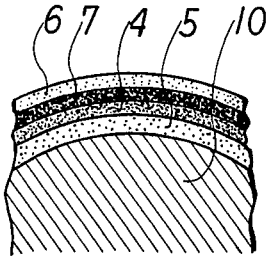
FIG. 3 is a schematic partially sectional view showing image layers transferred onto an object having a curved surface to be printed.

FIG. 1 is a schematic elevation of a curved surface printing machine usable in the process of the present invention, FIG. 2 is a schematic partially sectional view showing image layers transferred onto a blanket, and FIG. 3 is a schematic partially sectional view showing image layers transferred onto an object to be printed. The tackiness values of yellow, magenta, cyan and black inks are adjusted so that a first ink has the highest tackiness value, a second ink has a secondarily high tackiness value, a third ink has a thirdly high tackiness value and a fourth ink has the lowest tackiness value. Yellow, magenta, cyan and black blocks are prepared by a known photomechanical process. First, four halftone images are transferred from each block of block cylinders 2*a*, 2*b*, 2*c* and 2*d* arranged around a blanket cylinder 1 onto a blanket 3. The transferring from the blocks onto the blanket is conducted in such a way that the first ink image 4 is transferred onto a first transfer area of the blanket 3 as an under layer, onto which the second ink image 5 is transferred, and the third ink image 6 is transferred onto a second transfer area of the blanket 3 as an under layer, onto which the fourth ink image 7 is transferred, as shown in FIG. 2. The ink images of two layers on the first transfer area are then transferred onto an object 10 to be printed which is object 10 makes one revolution. Subsequently the ink images of two layers on the second transfer area are transferred onto the object 10 during further one revolution of the object 10 so that four halftone images are eventually transferred onto the object 10 in layers.

The object 10 to be printed is revolved in contact with the blanket cylinder 1 by the revolution of the blanket cylinder. In order to prevent the shear of register upon transferring from the blanket 3 to the object 10, the blanket cylinder may be connected to the mandrel which supports the object to be printed, through a means capable of controlling the revolution of the mandrel such as a gear. By such a means, it is possible to control the revolution so that at a constant speed the object to the printed makes exactly one revolution during the transference of the images on the first transfer area onto the object, and further makes exactly one revolution during the transference of the images on the second transfer area onto the object.

Figure 4:
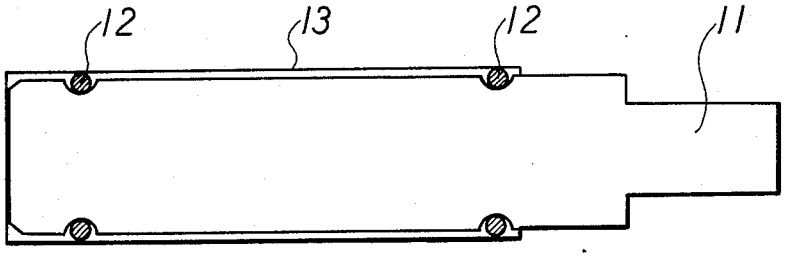
FIG. 4 is a schematic sectional view showing one instance of a mandrel having a means of preventing slip of an object to be printed, which may be employed in the process of the present invention.
Figure 5:
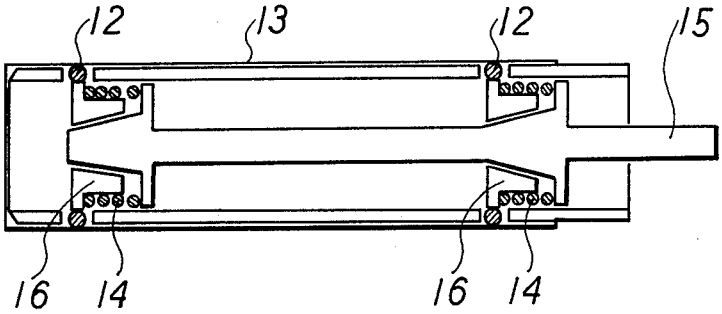
FIG. 5 is a schematic sectional view showing another instance of a mandrel having a means of preventing slip of an object to be printed, which may be employed in the process of the present invention.

Also, the use of a mandrel having an O-ring as shown in FIG. 4 or a mandrel of expansion type as shown in FIG. 5 may be effective for preventing the slip between an object to be printed and the mandrel. Such slip prevention means may be employed with the above-mentioned revolution control means.

In FIG. 4 showing one instance of the slip prevention means usable in the present invention, the numeral 11 is a mandrel, and the numeral 13 is a cylindrical object to be printed, around which O-ring 12 is fitted. In FIG. 5 showing another instance of the slip prevention means usable in the present invention, the numeral 14 is a spring. The slip between a cylindrical object 13 is to be printed and a mandrel is prevented by O-ring 12 which is expanded through a part 16 by the movement of an axis 15. Such a slip prevention means of expansion type is particularly available, since an object to be printed can be easily loaded and unloaded.

The present invention is more specifically described and explained by means of the following Examples.

Example 1

Four-color halftone printing of aerosol cans having an outer diameter of 50 mm. was continuously carried out under the following conditions.

Original pattern: scene reversal color film

Block: four-color process, 150 lines, Nyloprint of 0.55 mm. in thickness (photoresin plate material made by BSAF AG.)

Printing inks: process inks for metal made by Kabushiki Kaisha Matsui Kagaku Kogyosho
- Yellow: CAP process 23
- Magenta: CAP process 53
- Cyan: CAP process 365
- Black: CAP 97

Tackiness Value: Tackiness values of four inks were adjusted by CP compound made by Kabushiki Kaisha Matsui Kagaku Kogyosho
- Yellow: 29
- Magenta: 26
- Cyan: 23
- Black: 20

Blanket: Hard blanket 5400 (Hs 83) made by Dunlop Japan Ltd.

Printing speed: 66 r.p.m.

Number of printed cans: 4,000 pieces

The transferring from blocks onto a blanket was carried out in the order of yellow, cyan, magenta and black, and the yellow and cyan halftone images were transferred as under layers onto a first transfer area and a second transfer area, respectively.

Also, the revolution of aerosol cans was made by means of the friction drive between the aerosol can and the blanket.

No mixture of inks was observed, and the hue did not change and the dots did not flow. There was obtained a beautiful impression very closely resembling the original pattern and color.

Example 2

The procedure of Example 1 was repeated except that the tackiness values of yellow, magenta, cyan and black inks were adjusted to 36, 32, 28, 24, respectively to give a beautiful impression very closely resembling the original.

Comparative Example 1

The procedure of Example 1 was repeated except that the tackiness values of the yellow and cyan inks were adjusted to 29 and the tackiness values of the magenta and black inks were adjusted to 26. The obtained impression faded in color wholly.

Comparative Example 2

The procedures of Example 1 were repeated except that one of the four halftone images was transferred onto either transfer area and the other three halftone images were transferred onto another transfer area.

Mixture of the inks was observed, and the obtained impression faded in color wholly and showed a low key finishing.

What is claimed is:

1. In a process for four-color halftone printing by a dry offset printing system onto an object having a curved surface by transferring halftone images from four halftone blocks of block cylinders arranged around a blanket cylinder onto the blanket and then transferring the images onto the object, the improvement comprising maintaining the tackiness values of four inks consisting of first, second, third and fourth inks such that the first ink has the highest tackiness value and the fourth ink has the lowest tackiness value, wherein the difference in tackiness value between each of said four inks is at least 1, transferring the four halftone images from the halftone blocks onto two transfer areas on the blanket cylinder, the two transfer areas consisting of a first transfer area and a second transfer area positioned sequentially in the circumferential direction of the blanket cylinder, such that the image of said first ink is transferred onto said first transfer area as an under layer onto which the image of said second ink having the secondarily high tackiness value is transferred, and the image of said third ink is transferred onto said second transfer area as an under layer onto which the image of said fourth ink is transferred, and transferring the images transferred onto said first transfer area and the images transferred onto said second transfer area in order onto the objects in layers.

2. The process of claim 1, wherein said difference in tackiness value of four inks is from 2 to 3 from each other.

3. The process of claim 1, wherein the tackiness values of said first, second, third and fourth inks are maintained at 29 to 27, 26 to 24, 23 to 21 and 20 to 18, respectively.

* * * * *

UNITED STATES PATENT AND TRADEMARK OFFICE

CERTIFICATE OF CORRECTION

PATENT NO. : 4,241,657

DATED : December 30, 1980

INVENTOR(S) : HIKOICHIRO FUJIMORI

It is certified that error appears in the above-identified patent and that said Letters Patent are hereby corrected as shown below:

Col. 2, between lines 5 and 6, please insert --objects can be attained in a dry offset printing of an--;

Col. 2, in line 30, between "the" and "images", the "t" should be omitted; and

Col. 4, between lines 51 and 52, please insert --fixed to mandrel 9 provided on a rotating disc 8, while the--.

Signed and Sealed this

*Twenty-first* Day of *April 1981*

[SEAL]

*Attest:*

RENE D. TEGTMEYER

*Attesting Officer*

*Acting Commissioner of Patents and Trademarks*